US007950952B2

(12) United States Patent
Suzuki et al.

(10) Patent No.: US 7,950,952 B2
(45) Date of Patent: May 31, 2011

(54) FPC CONNECTOR WITH ROTATING LATCH

(75) Inventors: Teruhito Suzuki, Kozagun (JP); Hideyuki Hirata, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/226,046

(22) PCT Filed: Apr. 16, 2007

(86) PCT No.: PCT/US2007/009226
§ 371 (c)(1),
(2), (4) Date: Apr. 13, 2009

(87) PCT Pub. No.: WO2007/130260
PCT Pub. Date: Nov. 15, 2007

(65) Prior Publication Data

US 2009/0305550 A1 Dec. 10, 2009

(30) Foreign Application Priority Data

Apr. 14, 2006 (JP) ..... 2006-111960

(51) Int. Cl.
*H01R 3/00* (2006.01)

(52) U.S. Cl. ..... 439/494

(58) Field of Classification Search ..... 439/494–495, 439/261, 264, 492, 497, 329
See application file for complete search history.

(56) References Cited

U.S. PATENT DOCUMENTS 4,718,859 A * 1/1988 Gardner ..... 439/329
7,494,366 B2 * 2/2009 Suzuki et al. ..... 439/495
7,695,295 B2 * 4/2010 Hanyu ..... 439/153

FOREIGN PATENT DOCUMENTS

EP 0 966 070 A1 12/1999
WO WO 2005/114796 A1 12/2005

OTHER PUBLICATIONS

International Search Report for PCT/US2007/009226.

* cited by examiner

*Primary Examiner* — Jean F Duverne
(74) *Attorney, Agent, or Firm* — Timothy M. Morella

(57) ABSTRACT

A cable connector includes a housing with an insertion recess for receiving an end of a flat cable and a plurality of terminals disposed in the housing for connecting to conductive leads of the flat cable. An actuator is attached to the housing so that the attitude of the actuator can be changed between a first position at which the flat cable can be inserted into the opening and a second position at which the actuator presses the conductive leads of the inserted flat cable into contact with the terminals. The actuator is attached to the housing at a cable insertion end side thereof and brought to the second position when the attitude of the actuator is changed in an insertion direction of the flat plate-like cable. A fulcrum of the attitude-changing movement of the actuator in the insertion direction is positioned further from the second position, as viewed from an effort point of a force applied by the flat cable to the actuator at the second position, than a point of action of the force being applied.

20 Claims, 7 Drawing Sheets

FIG. 2
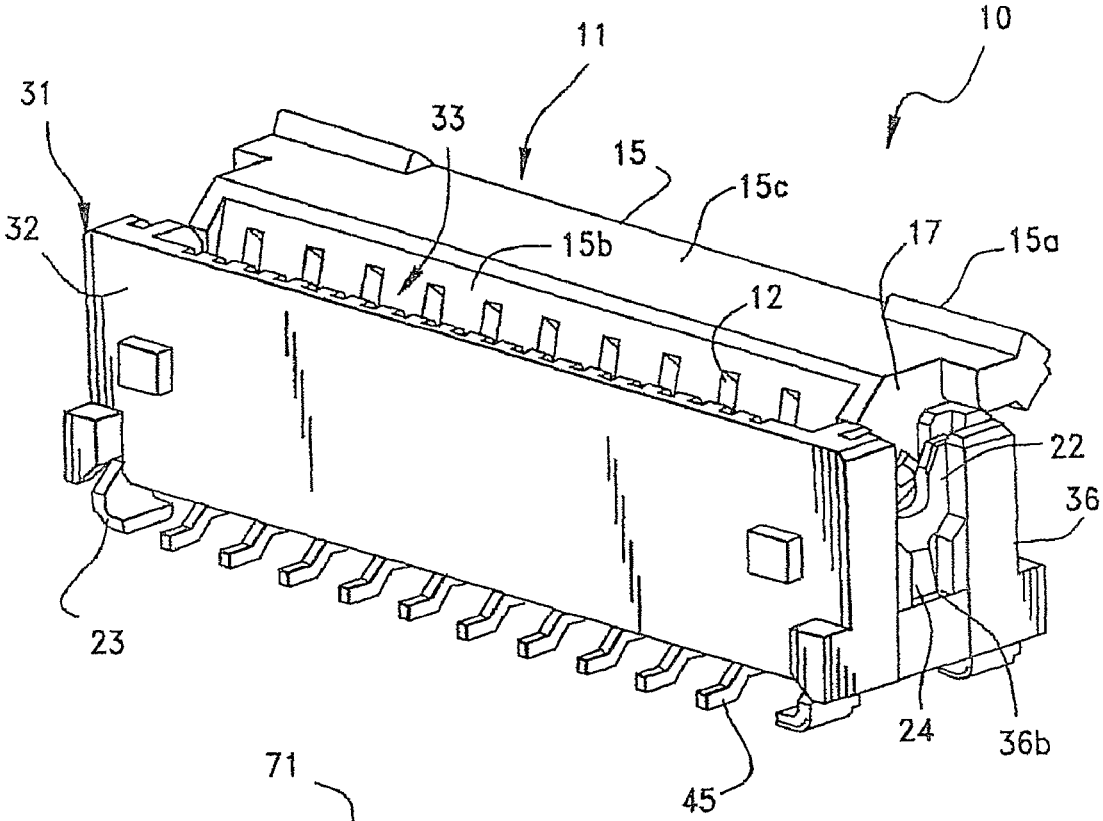
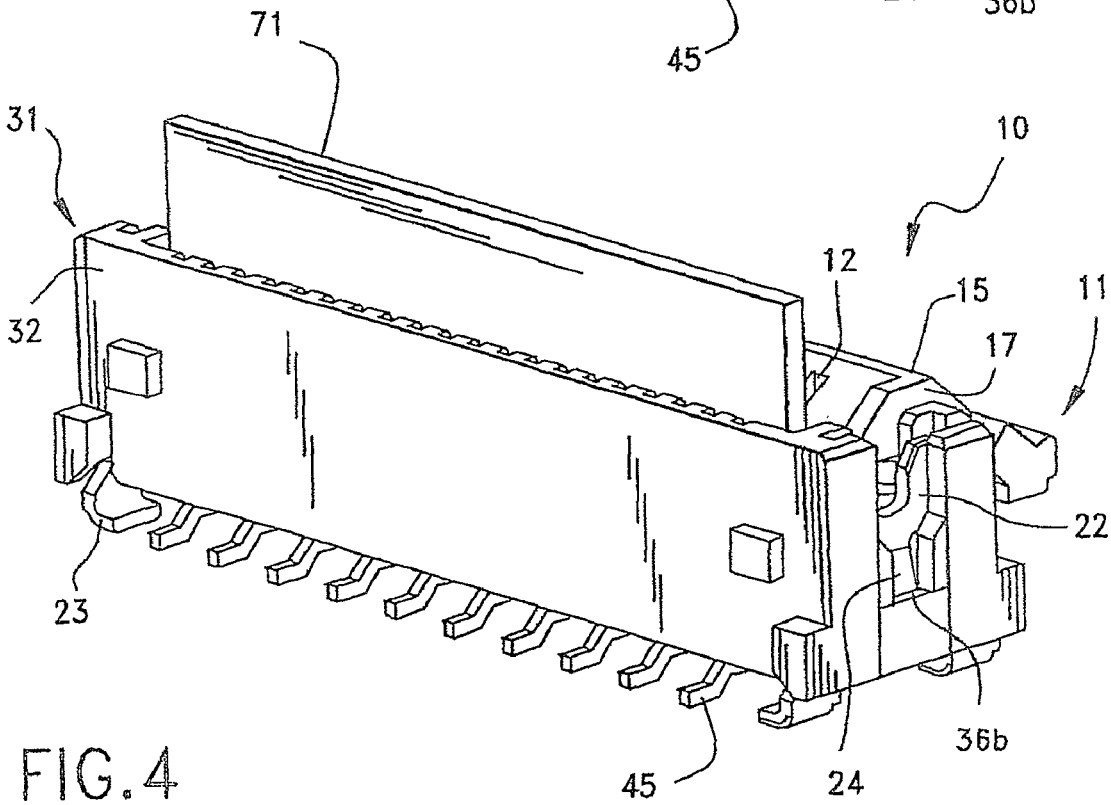
FIG. 4

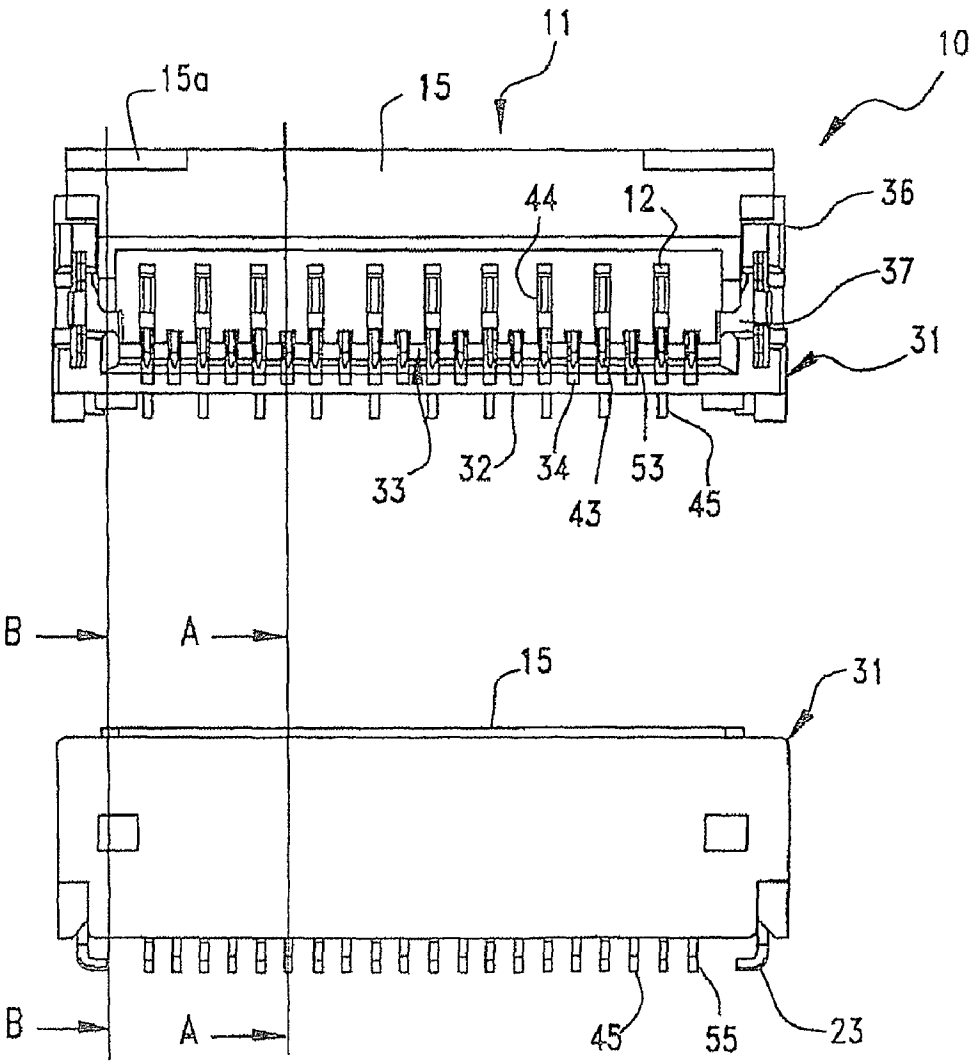
FIG.3A
FIG.3B
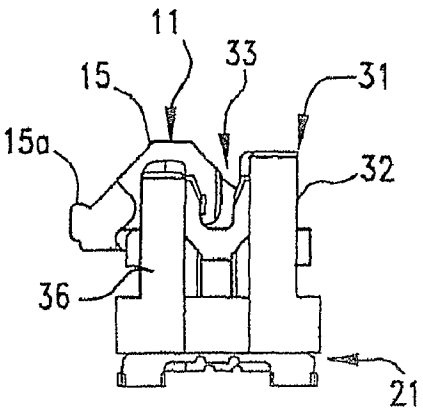
FIG.3C

FIG.6B
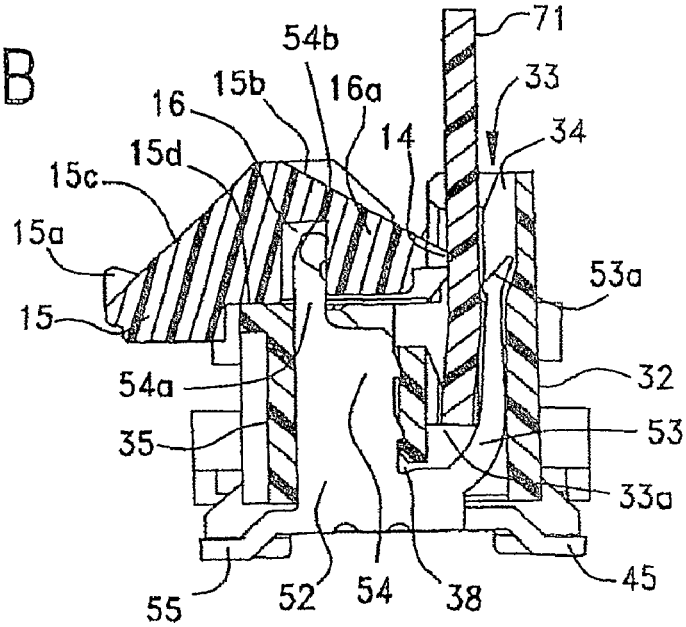
FIG.6A
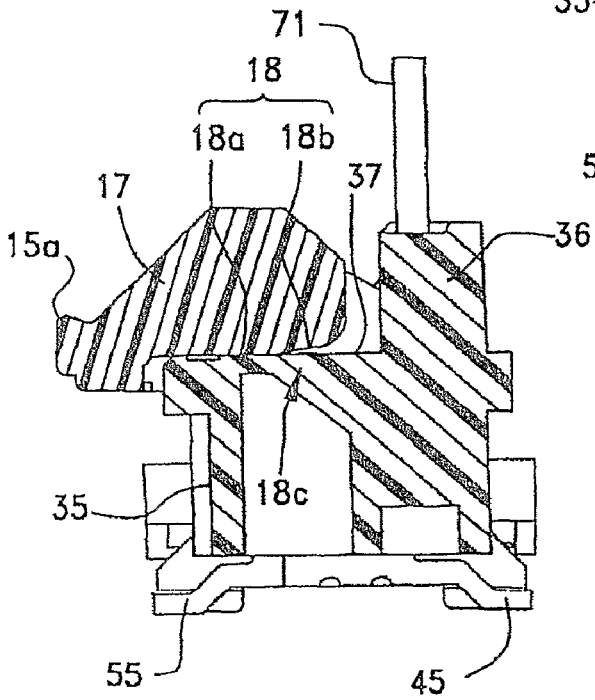
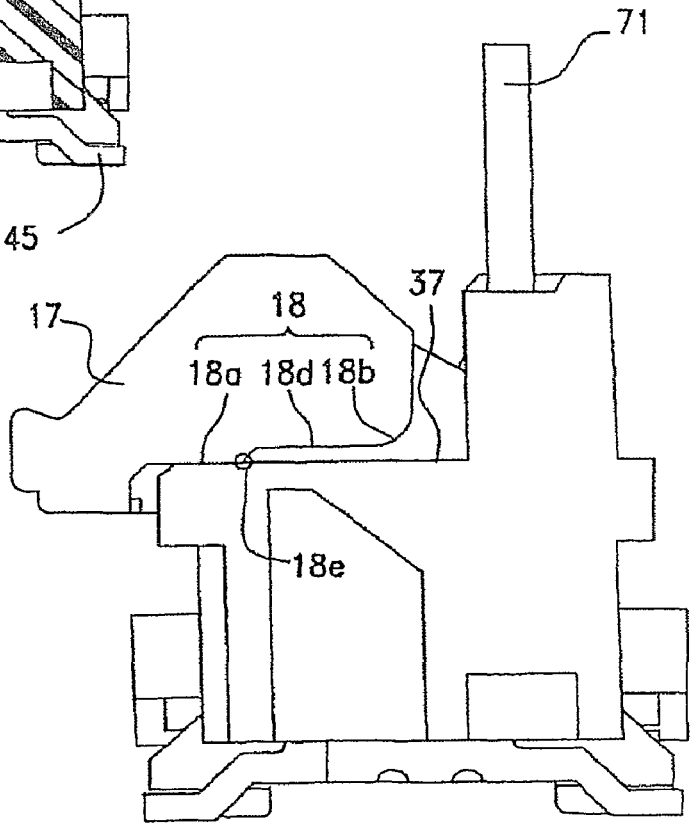
FIG.8

FIG.9
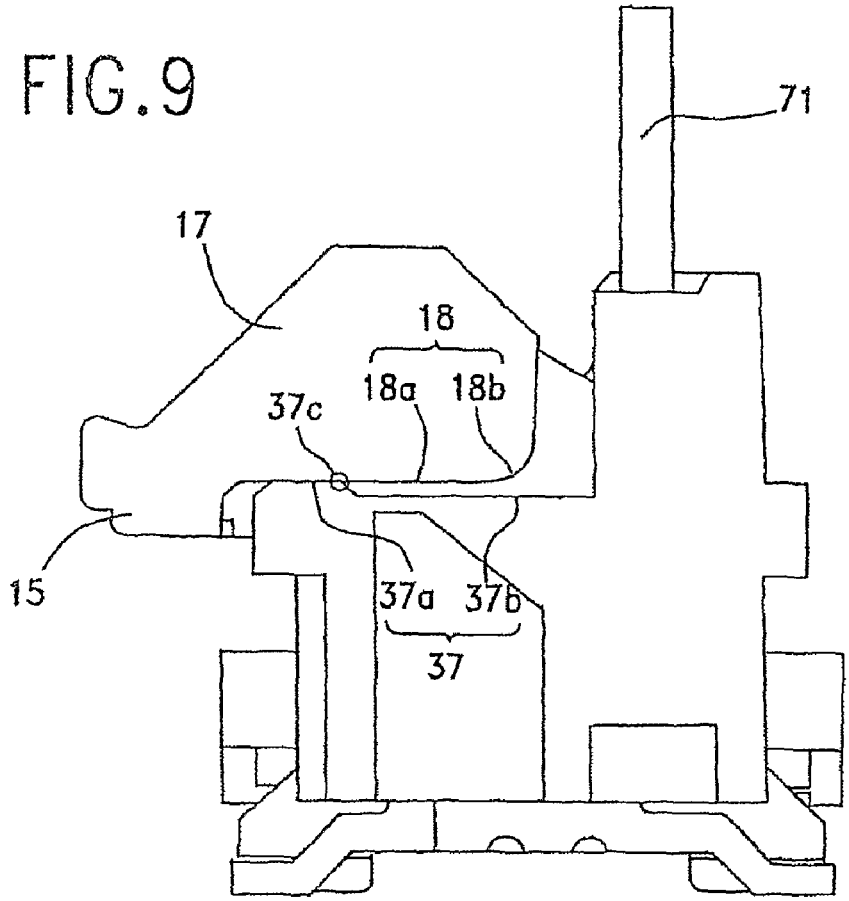
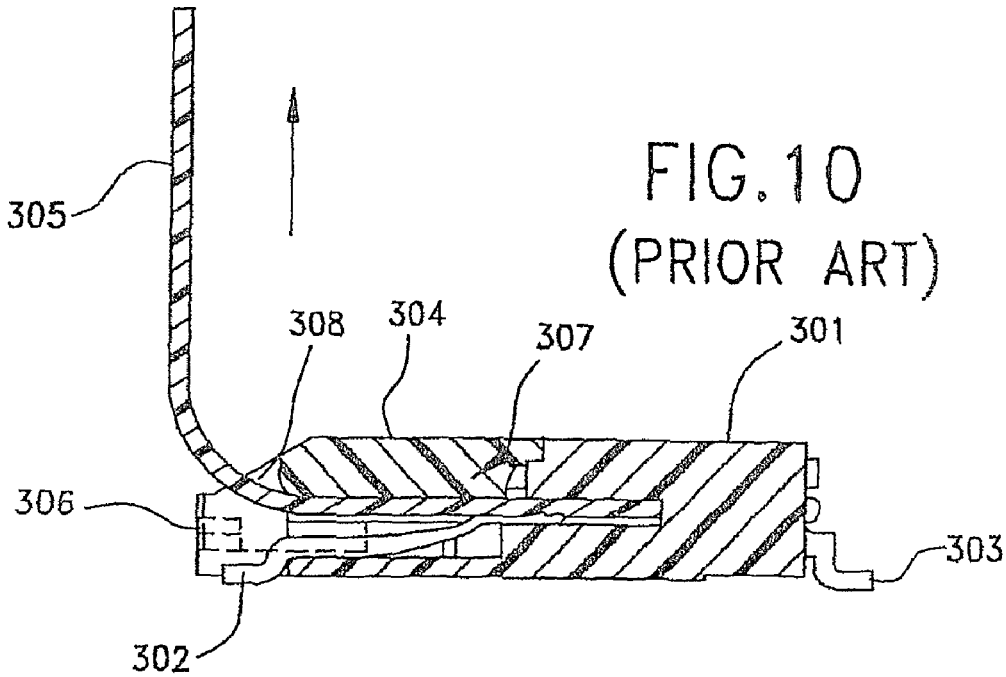
FIG.10
(PRIOR ART)

FPC CONNECTOR WITH ROTATING LATCH

BACKGROUND OF THE INVENTION

The present invention relates to a cable connector. Conventionally, cable connectors, such as FPC connectors, FFC connectors, are used to connect flexible flat plate-like cables which are called flexible printed circuits (FPC), flexible flat plate-like cables (FFC) or the like (refer to, for example, Japanese Patent Application Laid-Open (Kokai) No. 2001-57260).

FIG. 10 is a cross-sectional view showing a main part of a conventional cable connector.

As shown in the drawing, the cable connector includes a housing 301 made from an insulating material such as synthetic resin, and first terminals 302 and second terminals 303 which are made from a conductive material such as metal and held by the housing 301. On the top surface of the housing 301, an actuator 304 made from an insulating material such as synthetic resin is disposed. The actuator 304 is rotatably attached to the housing 301 and is rotated between a closed position shown in the drawing and an opened position. In this case, the flat plate-like cable 305 is inserted in the housing 301 from the opening thereof, with the actuator 304 at the opened position. Once the cable 305 is inserted all the way to the end of the opening, the actuator 304 is rotated by an operator's finger or the like to the closed position. Then, a locking portion 306 of the actuator 304 is engaged with a locking portion (not shown) of the housing 301 so that the actuator 304 is locked. Thus, the cable 305 is pressed by the actuator 304 from the top, and the connection portions exposed on the bottom surface of the cable 305 comes into contact with the first terminals 302 and the second terminals 303, which make them electrically conducted with each other. In addition, the attitude of the actuator 304 is fixed.

When such a connector is actually used, an operator handles the cable 305 connected to the cable connector in an unexpected direction, and, for example, the cable 305 may be pulled in the direction shown by the arrow in the drawing. Even in this situation, the locking portion 306 of the actuator 304 and the locking portion of the housing 301 are not disengaged because of the principle of leverage; the distance between the locking portion 306 and the rotation center 307 of the actuator 304 is longer than the distance between a point 308 where the pulling force is applied and the rotation center 307. Therefore, unwanted opening of the actuator 304 due to handling of the cable 305 is avoided.

However, in the conventional cable connector, by engaging the locking portion 306 of the actuator 304 with the locking portion of the housing 301, the attitude of the actuator 304 is fixed. This makes the structure of the actuator 304 and the housing 301 complex. Also, since the actuator 304 is rotated towards the entry end side of the opening portion of the housing 301 in order to bring the actuator 304 to the closed position, operability is reduced when this structure is applied to a so-called straight-type connector where the opening portion of the housing 301 is mounted in the perpendicular direction to a substrate.

The present invention is directed to an improved flat cable connector with a rotating latch member that avoids the aforementioned shortcomings.

SUMMARY OF THE INVENTION

An object of the present invention is to solve the above problems of conventional flat cable connectors, and to provide a cable connector including an actuator which is attached to a housing on the cable insertion side thereof so that the attitude of the actuator can be changed and it is brought to a cable holding position when its attitude is changed in the insertion direction of a flat plate-like cable, and in which when the actuator is at the cable holding position, the fulcrum of the rotation motion of the actuator is located farther, as viewed from the effort point thereof, than the point of action, and therefore, the cable connector has high operability, simple construction, and good holding capability, and is enabled to prevent unwanted disengagement due to handling of the flat plate-like cable to ensure secure connection of the flat plate-like cable.

In order to achieve the above objective, the present invention provides a cable connector including a housing having an insertion recess into which a flat plate-like cable is inserted, terminals loaded in the housing and electrically connected to conductive wires of the flat plate-like cable, and an actuator attached to the housing so that the attitude of the actuator can be changed between a first position at which the flat plate-like cable can be inserted and a second position at which the actuator causes the conductive wires of the inserted flat plate-like cable and the terminals to be electrically connected to each other, wherein the actuator is attached to the housing at a cable insertion end side thereof and brought to the second position when the attitude of the actuator is changed in an insertion direction of the flat plate-like cable, and a fulcrum of the attitude-changing movement of the actuator in the insertion direction further from the second position is located farther, as viewed from an effort point of a force applied by the flat plate-like cable to the actuator at the second position, than a point of action of the force.

In the preferred embodiment of the cable connector of the present invention, a distance between the effort point and the fulcrum is longer than a distance between the point of action and the fulcrum.

In the preferred embodiment of the cable connector of the present invention, the housing has a supporting surface, the actuator has a rolling surface for rolling on the supporting surface, and the rolling surface includes an attitude holding contact portion making contact with the supporting surface when the actuator is at the second position, and an attitude holding contact limit point located at the end of the attitude holding contact portion on the side of the flat plate-like cable, the attitude holding contact limit point functioning as the fulcrum.

In the preferred embodiment of the present invention, the rolling surface includes a curved surface portion connected to the attitude holding contact limit point on the side of the flat plate-like cable, and the curved surface portion contacts the supporting surface while the attitude of the actuator is changed from the first position to the second position, and is spaced apart from the supporting surface when the actuator is at the second position.

In the preferred embodiment of the present invention, the rolling surface further includes a stepped planar surface portion connected to the attitude holding contact limit point on the side of the flat plate-like cable, the stepped planar surface portion contacts the supporting surface while the attitude of the actuator is changed from the first position to the second position, and is spaced apart from the supporting surface when the actuator is at the second position, and the attitude holding contact limit point is a step.

In the preferred embodiment of the present invention, the housing has a supporting surface, the actuator has a rolling surface for rolling on the supporting surface, the supporting surface includes a main supporting surface portion which contacts the rolling surface when the actuator is at the second position, a stepped supporting surface portion which contacts the rolling surface while the attitude of the actuator is changed from the first position to the second position, and is spaced apart from the rolling surface when the actuator is at the second position, and a step at a border between the main supporting surface portion and the stepped supporting surface portion, the step functioning as the fulcrum.

In the preferred embodiment of the present invention, the actuator has a pressing portion which presses the flat plate-like cable against contact portions of the terminals when the actuator is at the second position, and the pressing portion functions as the effort point.

In the preferred embodiment of the present invention, the terminals include terminals having supporting arm portions extending towards the cable insertion end of the housing, the actuator has a side surface which contacts a surface of the housing facing the cable insertion end thereof at the second position, and terminal accommodating recesses which are open in the side surface and accommodate the supporting arm portions, and an opening end of the terminal accommodating recess on the side of the flat plate-like cable functions as the point of action.

A cable connector, according to another aspect of the present invention, includes a housing having an insertion recess into which the flat plate-like cable is inserted, terminals loaded in the housing and electrically connected to conductive wires of the flat plate-like cable, and an actuator attached to the housing so that the attitude of the actuator can be changed between a first position at which the flat plate-like cable can be inserted and a second position at which the actuator causes the conductive wires of the inserted flat plate-like cable and the terminals to be electrically connected to each other, wherein the housing has a supporting surface, the terminals include terminals having supporting arm portions extending towards the cable insertion end of the housing, the actuator has a pressing portion which presses the flat plate-like cable against contact portions of the terminals when the actuator is at the second position, a rolling surface for rolling on the supporting surface, a side surface which contacts a surface of the housing facing the cable insertion end thereof when the actuator is at the second position, and terminal accommodating recesses which are open in the side surface and accommodate the supporting arm portions, the rolling surface includes an attitude holding contact portion which contacts the supporting surface when the actuator is at the second position, and an attitude holding contact limit point located on a side of the flat plate-like cable of the attitude holding contact portion, and the attitude holding contact limit point is located farther, as viewed from the pressing portion, than an opening end of the terminal accommodating recess on the side of the flat plate-like cable when the actuator is at the second position.

A cable connector, according to a further aspect of the present invention, includes a housing having an insertion recess into which a flat plate-like cable is inserted, terminals loaded in the housing and electrically connected to a conductive wire of the flat plate-like cable, and an actuator attached to the housing so that the attitude of the actuator can be changed between a first position at which the flat plate-like cable can be inserted and a second position at which the actuator causes the conductive wires of the inserted flat plate-like cable and the terminals to be electrically connected to each other, wherein the housing has a supporting surface, the terminals include terminals having supporting arm portions extending towards the cable insertion end of the housing, the actuator has a pressing portion which presses the flat plate-like cable against contact portions of the terminals when the actuator is at the second position, a rolling surface for rolling on the supporting surface, a side surface which contacts a surface of the housing facing the cable insertion end thereof when the actuator is at the second position, and terminal accommodating portions which are open in the side surface and accommodate the supporting arm portions, the supporting surface includes a main supporting surface portion which contacts the rolling surface when the actuator is at the second position, a stepped supporting surface portion which contacts the rolling surface when the attitude of the actuator is changed from the first position to the second position and is spaced apart from the rolling surface when the actuator is at the second position, and a step at a border between the main support surface portion and the stepped supporting surface portion, and the step is located farther, as viewed from the pressing portion, than an opening end of the terminal accommodating portion on the side of the flat plate-like cable when the actuator is at the second position.

According to the present invention, the cable connector includes the actuator which is attitude-changeably attached to the insertion end side of the housing so that the actuator can be brought to a cable holding position when the attitude of the actuator is changed in the insertion direction of the flat plate-like cable, and when the actuator is at the cable holding position, the fulcrum of the rotation motion of the actuator is located farther, as viewed from the effort point, than the point of action. Therefore, the connector can realize high operability, easy structure, and high cable holding capability, and unwanted disengagement of holding the flat plate-like cable due to handling of the flat plate-like cable can be prevented, ensuring secure connection of the flat plate-like cable.

BRIEF DESCRIPTION OF THE DRAWINGS

The invention will be described in accordance with the following drawings, in which:

FIG. 2 is a perspective view of the connector according to the first embodiment of the present invention where the actuator is open;

FIGS. 3A to 3C are three side views of the connector according to the first embodiment of the present invention;

FIG. 4 is a perspective view of the connector according to the first embodiment of the present invention where the actuator of the connector is closed;

FIGS. 6A and 6B are cross-sectional views of the connector, showing the actuator in the state where the actuator according to the first embodiment of the present invention is at the closed position;

FIG. 8 is a cross-sectional view of a side wall of an actuator according to a second embodiment of the present invention;

FIG. 9 is a cross-sectional view of a side wall of a modification of the actuator of the second embodiment of the present invention; and FIG. 10 is a cross-sectional view showing a main part of a conventional cable connector.

DESCRIPTION OF THE PREFERRED EMBODIMENTS

Figure 1:
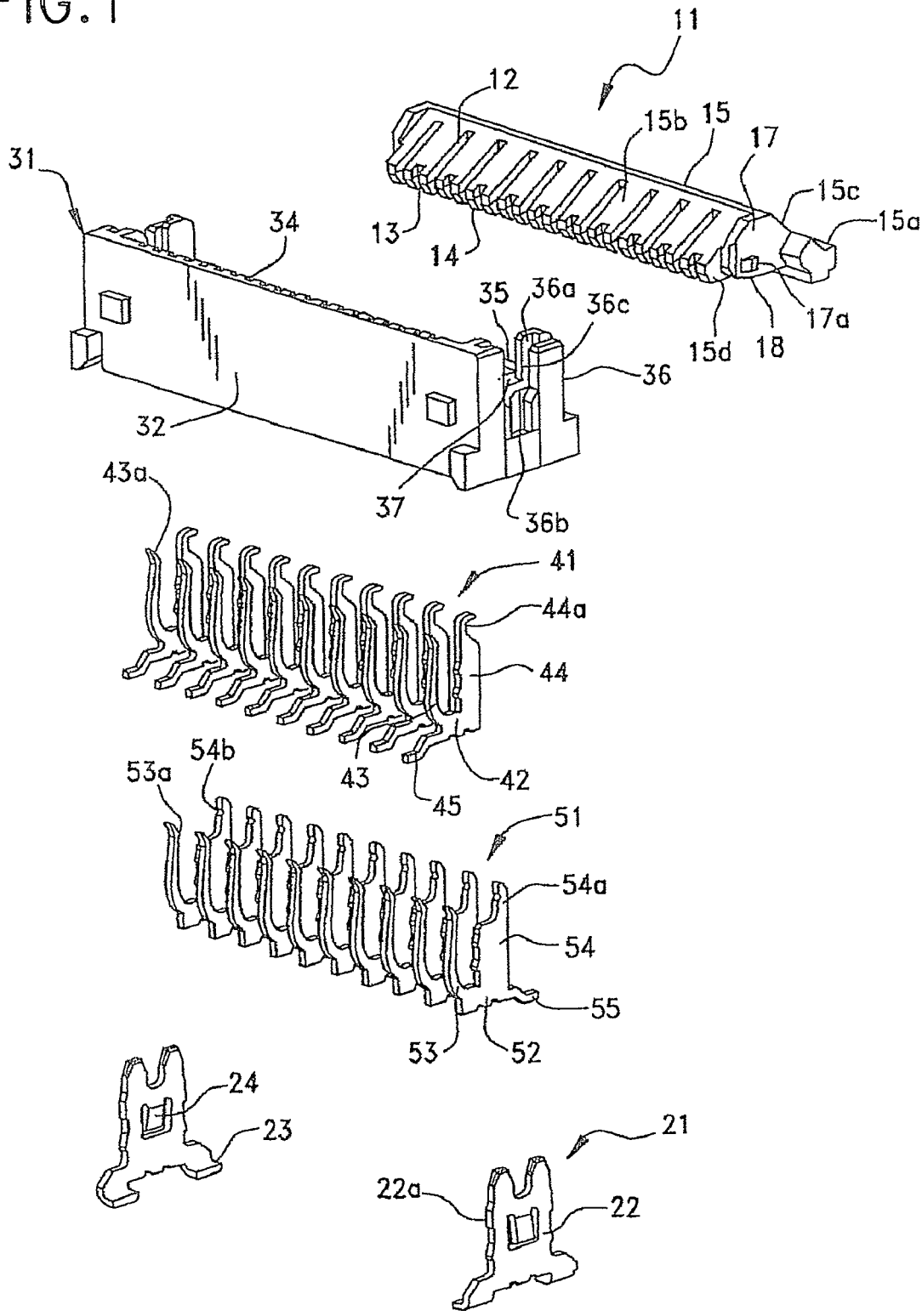
FIG. 1 is an exploded view of a cable connector according to a first embodiment of the present invention.

In these drawings, reference numeral 10 represents a connector as a cable connector in the embodiments. The connector 10 is mounted on a substrate (not shown) such as a circuit board, and is used to electrically connect a flat plate-like cable 71, which is called a flexible printed circuit, or the like, to the substrate.

In this embodiment, the connector 10 is of so-called straight type, where the connector 10 is mounted in the upright state with respect to the substrate, in other words, in the state wherein a cable insertion end into which the flat plate-like cable 71 is inserted is facing upward. The flat plate-like cable 71 is, for example, a flat plate-like flexible cable which is called FPC, FFC, or the like. However, any type of cable can be used as long as it is flat plate-like and has conductive wires (not shown).

The connector 10 includes a housing 31 integrally formed of an insulating material such as a synthetic resin, as a connector body, and an actuator 11 integrally formed of an insulating material such as synthetic resin, as a cable-fixing movable member attitude-changeably attached to the housing 31. In other words, the actuator 11 is disposed on the housing 31 so that the attitude of the actuator 11 is changed between an opened position as a first position and a closed position as a second position. Note that the actuator 11 is attitude-changeably attached to the housing 31 on the cable insertion end side thereof (the upper end side in FIG. 3C), and when the attitude of the actuator 11 is changed in the insertion direction (downward in FIG. 3C) of the flat plate-like cable 71, it is brought to the closed position, i.e., the cable holding position.

The housing 31 includes an approximately rectangular, flat plate-like first portion 32, a thick plate-like second portion 35 opposing the first portion 32, left and right side portions 36 connecting the longitudinal end sides of the first portion 32 and the second portion 35, and an insertion recess 33 formed among the first portion 32, the second portion 35 and side portions 36 as a recess opening toward the cable insertion end side of the housing 31 in order to insert the end of the flat plate-like cable 71 (now shown) from the above. Note that the flat plate-like cable is inserted from above toward the bottom. In the second portion 35, a plurality of terminal holding recesses 38 for accommodating and holding metal terminals are arrayed in parallel, as described later. Further, flat supporting surfaces 37 for supporting the actuator 11 are formed on the inner sides of both side portions 36, respectively, and engaging surfaces 36*c* for engagement with engaging raised portions 17*a* of the actuator 11, are formed in grooves formed in the side portions 36.

In this embodiment, the terminals include first terminals 41 and second terminals 51, and the terminal holding recesses 38 includes first terminal holding recesses where the first terminals 41 are accommodated and held, and second terminal holding recesses where the second terminals 51 are accommodated and held. Preferably, the first terminals 41 and the second terminals 51 are formed by punching metal plates. The number of the first terminal holding recesses and the second terminal holding recesses are, for example, 20 in total, with an about 0.5 mm-pitch. Note that the pitch and number of the aforementioned terminal receiving grooves may be changed as appropriate. Also, the first terminal holding recesses and the second terminal holding recesses are disposed alternately so that each of them comes to adjacent to each other. Note that the first terminals 41 and the second terminals 50 do not necessarily have to be fitted in all the first terminal holding recesses and the second terminal holding recesses; the first terminals 41 and the second terminals 51 may be omitted as necessary according to an array of conductive wires provided in the flat plate-like cable 71.

Further, as shown in FIG. 1, slit-shaped nail accommodating recesses 36*a* are formed in the side portions 36 of the housing 31, extending in the insertion direction of the flat plate-like cable 71, and in the nail accommodating recesses 36*a*, metal nails 21 are accommodated as auxiliary fittings for connector attachment. It is preferred that each nail 21 be formed by processing such as punching or bending a metal plate, and has a plate-like body 22, uneven portions 22*a* formed on the side edges of the body 22, a tongue-faced engaging piece 24 formed by cutting in a part of the body 22, and the substrate attaching portions 23 connected to the bottom end of the body 22.

When the nail 21 is inserted into the nail accommodating recess 36*a* from below the housing 31, the uneven portions 22*a* bite into the inner walls of the nail accommodating portion 36*a*, and the engaging piece 24 engages with a latching recess portion 36*b* formed in the side portion 36. As a result, the nail 21 is held within the nail accommodating recess 36*a*. Note that the substrate attaching portions 23 project downwardly from the bottom surfaces of the side portions 36. The substrate attaching portions 23 are secured to the surfaces of connecting pads or the like of the substrate by using securing means such as soldering. This realizes strong attachment of the connector 10 to the substrate, thus preventing the connector 10 from being detached from the substrate.

Moreover, the actuator 11 is an approximately triangular rod-like member, and has a body 15 including three side surfaces extending along the longitudinal direction: that is, a first side surface 15*b*, a second side surface 15*c*, and a third side surface 15*d*. In addition, the actuator 11 includes an operating portion 15*a* designed to protrude from the body 15, a plurality of slit-shaped first terminal accommodating recesses 12 formed in the body 15, a plurality of second terminal accommodating grooves 13 and pressing portions 14 formed in the peak portion on the boundary between the first side surface 15*b* and the third side surface 15*d* in the body 15, and second terminal accommodating recesses 16 described later. Note that the first terminal accommodating recesses 12 and the second terminal accommodating grooves 13 are disposed alternately, sandwiching the pressing portions 14 therebetween. Also the second terminal accommodating recesses 16 are opened in the third surface 15*d*.

Furthermore, side walls 17 are formed on both longitudinal ends of the body 15, respectively, and the bottom surface of each side wall 17 functions as a rolling surface 18. As the attitude of the actuator 11 is changed from the opened position to the closed position, the rolling surfaces 18 roll on the supporting surfaces 37 of the housing 31. Note that an engaging raised portion 17*a* is formed on the surface of each side wall 17. When the actuator 11 comes to the closed position, the engaging raised portions 17*a* are engaged with the engaging surfaces 36*c* of the housing 31, respectively, avoiding further attitude change of the actuator 11.

Here, each of the first terminals 41 has an approximately U-shaped side surface shape, and is provided with a first arm portion 43 and a second arm portion 44 extending in the direction for inserting/pulling-out the flat plate-like cable 71 into/from the insertion recess 33, in other words, a direction parallel to the insertion/pull-out direction, and a connecting portion 42 connecting the first arm portion 43 and the second arm portion 44. Further, a tail portion 45 as a connecting portion extends in a direction opposite to the second arm portion 44 and downward from the connecting point between the first arm portion 43 and the connecting portion 42. As the second arm portion 44 is press-fit into the first terminal holding recess and held therein, each of the first terminals 41 is loaded in the housing 31. Note that the tip of each of the second arm portion 44 projects above the second portion 35 of the housing 31 and enters each of the first terminal accommodating recesses 12 of the actuator 11. Thereafter, a shaft receiving recess 44*a* formed adjacent to the tip of each of the second arm portion 44 is engaged with a shaft (not shown) formed within each of the first terminal accommodating recesses 12.

Further, the first arm portion 43 serves as a contacting piece, which is accommodated in each terminal accommodating groove 34 on the surface of the first portion 32 of the housing 31, the surface facing the second portion 35 of the housing 31, and is electrically connected to the conductive wire included in the flat plate-like cable 71 inserted into the insertion recess 33. Note that, near the tip of each first arm portion 43, a contacting portion 43*a* is formed as a contact portion which projects towards the second arm portion 44 and comes into contact with the conductive wires.

Furthermore, each of the tail portions 45 projects downward from the bottom surface of the first portion 32 of the housing 31. By securing the tail portions 45 to the surface of the substrate such as conductive pads or the like by using securing means like soldering, the first terminals 41 are electrically conducted to conductive traces connected to conductive pads or the like, and attached to the substrate at the same time.

Meanwhile, each of the second terminals 51 has an approximately U-shaped side surface shape, and is provided with a first arm portion 53 and a second arm portion 54 extending in a direction parallel to the insertion/pull-out direction of the flat plate-like cable 71, and a connecting portion 52 for connecting the first arm portion 53 and the second arm portion 54. Further, a tail portion 55 as a connecting portion extends in a direction opposite to the first arm portion 53 and downward from the connecting point between the second arm portion 54 and the connecting portion 52. As the second arm portion 54 is press-fit into the second terminal holding recess and held therein, each of the second terminals 51 is loaded in the housing 31. Note that the tip portion 54*a* of each second arm portion 54 functions as a supporting arm portion, projects above the second portion 35 of the housing 31 and enters each of the second terminal accommodating recesses 16 of the actuator 11 serving as a terminal accommodating recess. An engaging recess 54*b* formed in a tip portion 54*a* is engaged with an opening end 16*a* of each of the second terminal accommodating recesses 16 when the actuator 11 is at the opened position.

Further, the first arm portion 53 serves as a contacting piece, which is accommodated in each terminal accommodating groove 34 of the housing 31 and electrically connected to the conductive wire included in the flat plate-like cable 71 inserted into the insertion recess 33. Note that, near the tip of each of the first arm portions 53, a contacting portion 53*a* is formed as a contact portion which projects towards the second arm portion 54 and comes into contact with the conductive wires.

Furthermore, each tail portion 55 projects downward from the bottom surface of the second portion 35 of the housing 31. By securing the tail portions 55 to the surface of the substrate such as a conductive pad or the like by using securing means like soldering, the second terminals 51 are electrically conducted to a conductive trace connected to a conductive pad or the like, and attached to the substrate at the same time. Note that the tail portions 45 of the first terminals 41 and the tail portions 55 of the second terminals 51 are arranged in zigzag when viewed from the top.

As shown in FIG. 2, when the actuator 11 is at the opened position, the operating portion 15*a* is located on the top, the second side surface 15*c* is almost horizontal, the first side surface 15*b* is tilted to near-vertical, and the peak portion on the border between the first side surface 15*b* and the third side surface 15*d* faces downward. Therefore, a space between the pressing portions 14 of the actuator 11 and the first portion 32 of the housing 31 is wide, and a space between the contacting portion 43*a* extending from the first arm portion 43 of each of the first terminals 41 accommodated in terminal accommodating grooves 34 of the first portion 32 and the contacting portion 53*a* extending from the first arm portion 53 of each of the second terminals 51, and the foregoing pressing portion 14 has sufficient width. Therefore, the end of the flat plate-like cable 71 to be inserted to the insertion recess 33 is inserted all the way to the end with no or only little contact pressure applied by the contacting portions 43*a* and 53*a* and the pressing portion 14. Hence, a substantial ZIF (zero insertion force) structure is realized.

Next, the operation for connecting the flat plate-like cable 71 to the connector 10 is described.

Figure 5A:
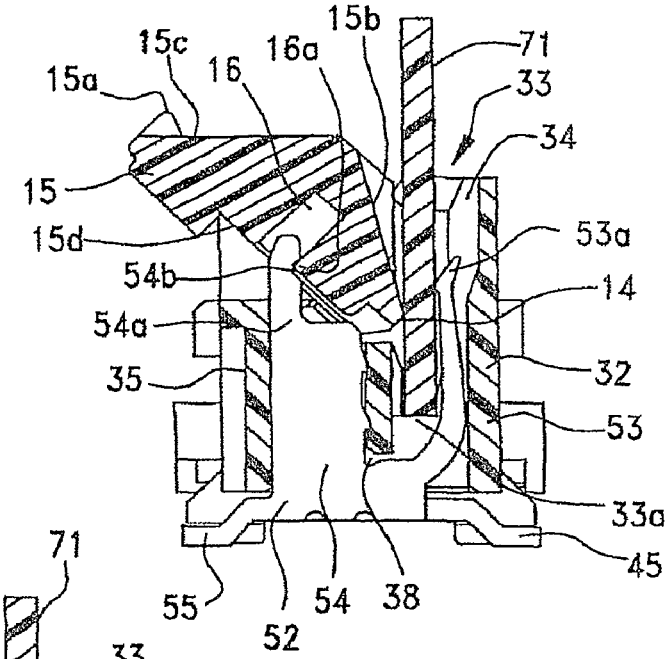
FIGS. 5A to 5C are cross-sectional views of the connector with the attitude-changeable actuator in various positions according to the first embodiment of the present invention.
Figure 5B:
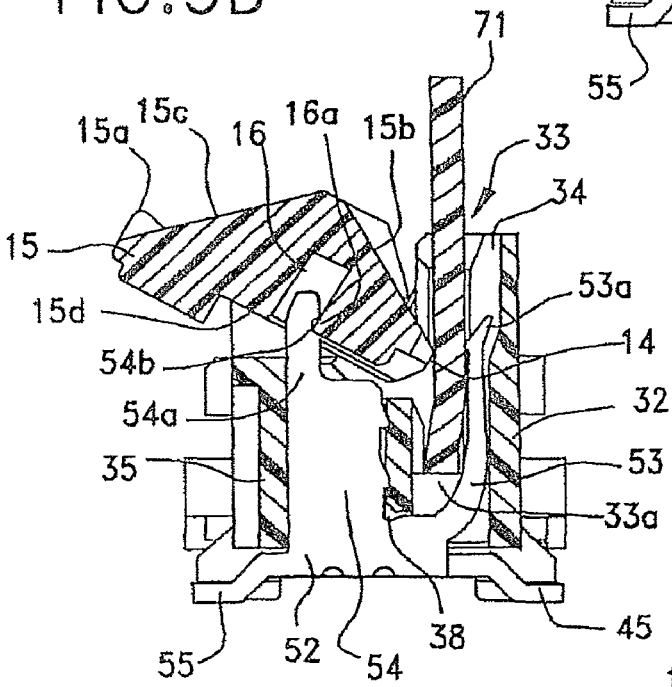
Figure 5C:
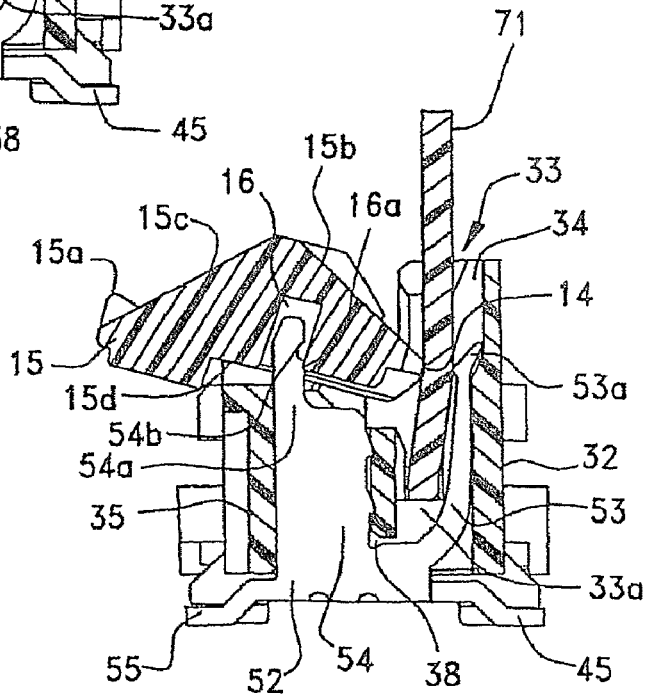

FIGS. 5A to 5C are cross-sectional views showing the attitude-change of the actuator according to the first embodiment of the present invention, and FIGS. 6A and 6B are cross-sectional views showing a state where the actuator is at the closed position according to the first embodiment of the present invention. Note that FIGS. 5A to 5C are cross-sectional views, taken along the arrows A-A in FIGS. 3A and 3B, FIG. 6A is a cross-sectional view, taken along the arrows B-B in FIGS. 3A and 3B, and FIG. 6B is a cross-sectional view, taken along the arrows A-A in FIGS. 3A and 3B.

Here, it is assumed that the connector 10 is mounted upright on the substrate, by connecting the tail portions 45 of the first terminals 41 and the tail portions 55 of the second terminals 51 to the conductive pads formed on the surface of the substrate by soldering or the like, and by connecting the substrate attaching portions 23 of the nails 21 to the connecting pads formed on the surface of the substrate by soldering.

Further, in the flat plate-like cable 71, a plurality of, for example, 15, foil-type conductive wires are disposed in parallel with a predetermined pitch, for example, with about 0.5 mm-pitch, on an insulating layer which has electrically insulating properties. The upper surfaces of conductive wires are covered with another insulating layer. At the end of the flat plate-like cable 71 to be inserted into the insertion recess 33 of the connector 10, the upper surfaces of the conductive wires are exposed in the area along a predetermined length. In the example shown in FIGS. 5A to 5C, it is assumed that the conductive wires are exposed on the right side of the flat plate-like cable 71.

When connecting the flat plate-like cable 71 to the connector 10, the end of the flat plate-like cable 71 in the longitudinal direction (the bottom end in FIGS. 5A to 5C) is first inserted into the insertion recess 33 of the housing 31. At this time, as shown in FIGS. 2 and 5A, the actuator 11 is brought to the opened position in advance. When the actuator 11 is at the opened position, the second side surface 15*c* of the body 15 is almost horizontal. Also, the tip of the tip portion 54*a* of each of the second terminals 51 enters each of the second terminal accommodating recesses 16 opened in the third side surface 15*d*, and the engaging recess 54*b* formed in each of the tip portions 54*a* is engaged with the opening end 16*a* of each of the second terminal accommodating recesses 16.

Thereafter, an operator moves the longitudinal end of the flat plate-like cable 71 toward the end of the insertion recess 33 of the housing 31 (downward in FIGS. 5A to 5C. Therefore, the longitudinal end of the flat plate-like cable 71 can be inserted into the insertion recess 33. Note that the flat plate-like cable 71 may be moved so that the exposed surfaces of the conductive wires face the terminal accommodating grooves 34.

Then, the tip of the flat plate-like cable 71 is inserted while passing between the actuator 11, and the first arm portions 43 of the first terminals 41 and the first arm portions 53 of the second terminals 51, which are accommodated in the terminal accommodating grooves 34. At this time, as shown in FIG. 5A, the peak portion on the boundary between the first side surface 15*b* and the third side surface 15*d* faces down, and the space between the pressing portion 14 and the contacting portions 43*a* and 53*a* is wide, so the end of the flat plate-like cable 71 can be inserted all the way to the end while no or only little contact pressure is applied. Then, once the tip of the flat plate-like cable 71 contacts a positioning member 33*a* disposed within the insertion recess 33, the position of the flat plate-like cable 71 in the longitudinal direction is decided, completing the insertion of the flat plate-like cable 71.

Next, an operator operates the operating portion 15*a* of the actuator 11 by his/her finger or the like to change the attitude of the actuator 11 at the opened position in the insertion direction of the flat plate-like cable 71, in other words, the attitude is changed downward in FIGS. 5A to 5C. Then, the operating portion 15*a* moves downwards, and the second side surface 15*c* is tilted. At the same time, the pressing portion 14 moves upwards and closer to the first portion 32 of the housing 31, pressing the flat plate-like cable 71 against the contacting portions 43*a* and 53*a*. Note that FIG. 5B shows a state where the angle of the second side surface 15*c* is about 15 degrees relative to the horizontal plane. In this state, the engaging recesses 54*b* are still engaged with the opening ends 16*a* of the second terminal accommodating recesses 16.

Next, when the attitude of the actuator 11 is further changed, the operating portion 15*a* moves down further, and, at the same time, the second side surface 15*c* is titled further. The pressing portion 14 moves upward further and even closer to the first portion 32 of the housing 31, thus pressing the flat plate-like cable 71 against the contacting portions 43*a* and 53*a*. Note that FIG. 5C shows a state where the angle of the second side surface 15*c* is about 30 degrees relative to the horizontal plane. In this state, the engaging recesses 54*b* are disengaged from the opening ends 16*a* of the second terminal accommodating recesses 16, the tip of each tip portion 54*a* enter each of the second terminal accommodating recesses 16 further, and the opening ends 16*a* contact the side surfaces of the tip portions 54*a* on the flat plate-like cable 71 side.

Thereafter, once the actuator 11 is at the closed position, connection of the flat plate-like cable 71 to the connector 10 is completed, and, as shown in FIG. 6B, the angle of the second side surface 15*c* is at about 45 degrees relative to the horizontal plane. When the actuator 11 is at the closed position, since the pressing portions 14 are close to the first portion 32 of the housing 31, the flat plate-like cable 71 is pressed by the pressing portions 14 against the contacting portions 43*a* and 53*a*. Therefore, the exposed conductive wires on the surface of the flat plate-like cable 71 contact the contacting portions 43*a* and 53*a* to create electrical connecting portions. Thus, the conductive wires are electrically connected to the first terminals 41 and the second terminals 51, and electrically conducted to the conductive traces of the substrate via the connecting pads on the surface of the substrate, to which the tail portions 45 and 55 are connected. Note that the first arm portions 43 and 53 have some spring properties and elastically deform by being pressed against the flat plate-like cable 71. Therefore, connection between the conductive wires and the contacting portions 43*a* and 53*a* can be well-maintained.

Also, as shown in FIG. 6B, the third side surface 15*d* contacts the top surface of the second portion 35, and the inner surface and the opening end 16*a* of the second terminal accommodating recess 16 on the flat plate-like cable 71 side contacts the side surface of the tip portion 54*a* on the flat plate-like cable 71 side. Further, as shown in FIG. 6A, a planar surface portion 18*a* of the rolling surface 18 of the side wall 17 contacts the supporting surfaces 37 of the housing 31. The rolling surface 18 includes a curved surface portion 18*b* which rolls on the supporting surface 37 of the housing 31 while the attitude of the actuator 11 is changed from the opened position to the closed position, and the planar surface portion 18*a* which functions as an attitude holding contact portion that contacts the supporting surface 37 when the actuator 11 is at the closed position. While the actuator 11 is at the closed position, the curved surface portion 18*b* is spaced apart from the supporting surface 37, and the planar surface portion 18*a* contacts the supporting surface 37. Moreover, reference numeral 18*c* represents an attitude holding contact limit point on the border between the planar surface portion 18*a* and the curved surface portion 18*b*, and serves as a fulcrum of a rotation motion when a force is applied to the actuator 11 by handling of the flat plate-like cable 71 connected to the connector 10.

In this embodiment, the length of the planar surface portion 18*a* is reduced, and the length of the curved surface portion 18*b* is increased. Accordingly, the attitude holding contact limit portion 18*c* is shifted in the direction away from the flat plate-like cable 71 (to the left in FIG. 6A). Therefore, the distance between a point where the flat plate-like cable 71 contacts the pressing portions 14 and the attitude holding contact limit point 18*c* is longer than the distance between a point where the opening end 16*a* contacts the tip portion 54*a* and the attitude holding contact limit point 18*c*. This means that the fulcrum of the rotation motion of the actuator 11 is located farther, as viewed from the effort point, than the point of action. Therefore, even if a force is applied to the actuator 11 due to handling of the flat plate-like cable 71 connected to the connector 10, the actuator 11 does not rotate, and the flat plate-like cable 71 is not removed from the connector 10.

Next, a force applied to the actuator 11 due to handling of the flat plate-like cable 71 is described.

Figure 7B:
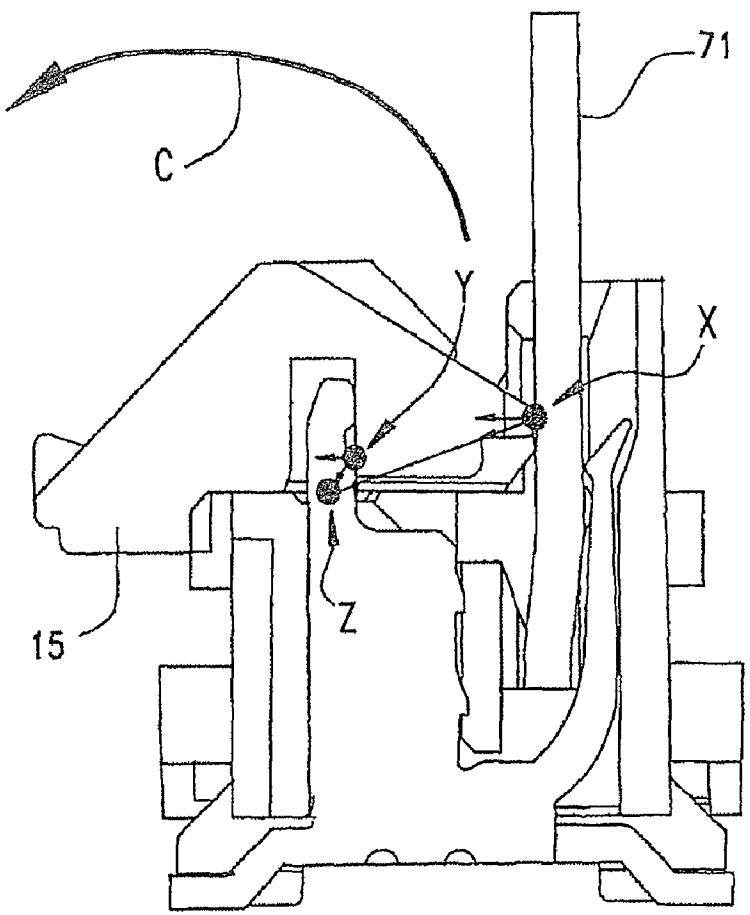
FIGS. 7A and 7B are views explaining a force applied to the actuator according to the first embodiment of the present invention.
Figure 7A:
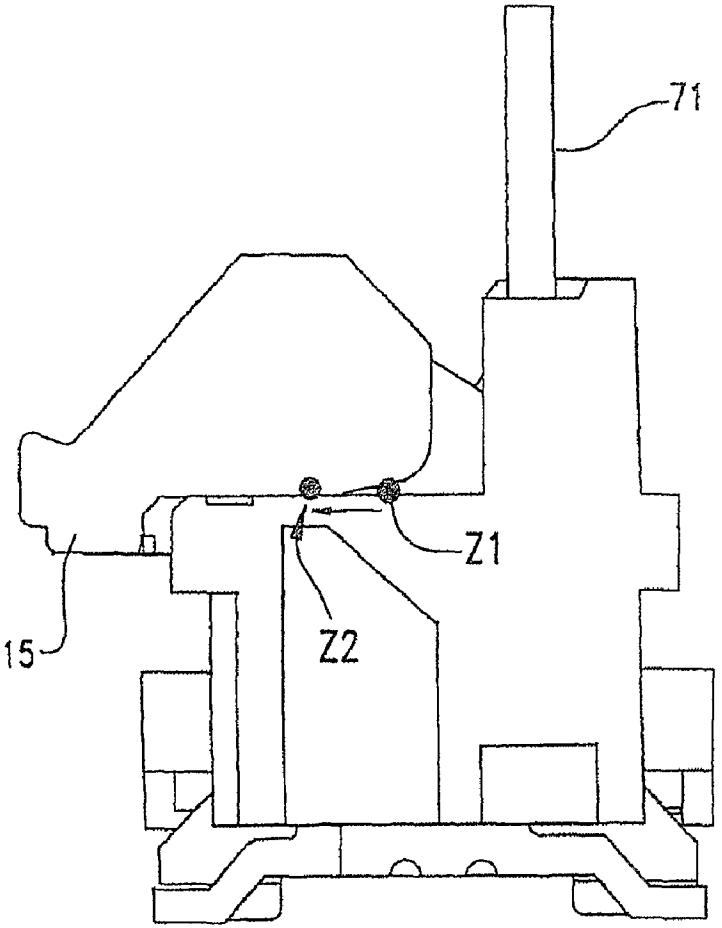

FIGS. 7A and 7B are views explaining a force applied to the actuator according to the first embodiment of the present invention. Note that FIGS. 7A and 7B are schematic cross-sectional views corresponding to FIGS. 6A and 6B, respectively.

When the substrate, on which the connector 10 is mounted with one end of the flat plate-like cable 71 is inserted therein, is moved, or when the other end of the flat plate-like cable 71 is moved, the flat plate-like cable 71 is sometimes pulled and bent, as shown by the arrow C in FIG. 7B. In such a case, an anticlockwise moment in this drawing, that is, a moment that causes a further attitude change of the actuator 11 in the insertion direction of the flat plate-like cable 71 is generated, and the actuator 11 may be detached from the housing 31. As a result, the flat plate-like cable 71 may possibly be detached from the connector 10. However, in this embodiment, since the attitude holding contact limit point 18*c* is shifted in the direction away from the flat plate-like cable 71, the actuator 11 will not rotate in the anticlockwise direction, and will not be detached from the housing 31. As a result, the flat plate-like cable 71 will not be detached from the connector 10.

In other words, the attitude holding contact limit point 18*c* is normally located at Z1 in FIG. 7A. On the other hand, in this embodiment, by reducing the length of the planar surface portion 18*a* and increasing the length of the curved surface portion 18*b*, the attitude holding contact limit point 18*c* is shifted away from the flat plate-like cable 71. Therefore, the attitude holding contact limit point 18*c* is at the position Z2.

In addition, when the anticlockwise moment is applied to the actuator 11 at the closed position, the attitude holding contact limit point 18*c* functions as the fulcrum of the rotation motion.

As shown in FIG. 7B, when viewed in a cross-section passing through the second terminal 51, a force caused by pulling and bending the flat plate-like cable 71 is applied to the pressing portion 14. In other words, a point X where the flat plate-like cable 71 contacts the pressing portion 14 functions as the effort point. Further, a point Z corresponding to the point Z2 in FIG. 7A serves as the fulcrum of a rotation motion of the actuator 11. Moreover, the tip portion 54*a* of the second terminal 51 for avoiding rotation motions of the actuator 11 receives a force from the opening end 16*a* contacting the tip portion 54*a*. This means that a point Y where the opening end 16*a* contacts the tip portion 54*a* serves as a point of action at which a force caused by pulling and bending the flat plate-like cable 71 is applied to the tip portion 54*a*.

Direction components of a force applied to the point X, which serves as the effort point due to pulling and bending the flat plate-like cable 71, are indicated by arrows from the point X, and direction components of the force generated to the point Y, which serves as the point of action, are indicated by arrows from the point Y. Since the distance between the point X and the point Z is longer than the distance between the point Y and the point Z, the force applied to the point Y serving as the point of action is directed obliquely downward. In other words, the force acts in the direction so as to press the actuator 11 downward. Hence, even if the force applied to the point X due to pulling and bending the flat plate-like cable 71 is large, the actuator 11 will not be removed from the housing 31.

On the other hand, when the attitude holding contact limit point 18*c* is located at Z1, the point Z which serves as the fulcrum of the rotation motion is located more to the right in FIG. 7B, somewhere between the point X and the point Y. In this case, the force applied to the point Y, which serves as the point of action, is directed obliquely upward, in such a direction that it pushes the actuator 11 upward. Therefore, because of a force applied the point X due to pulling and bending the flat plate-like cable 71, the actuator 11 is easily removed from the housing 31.

As described above, according to this embodiment, in the connector 10, the actuator 11 is attached to the housing 31 on the cable insertion end side, and is at the closed position when the attitude thereof is changed in the insertion direction of the flat plate-like cable 71. In addition, the fulcrum of the motion when the attitude of the actuator 11 is changed further in the insertion direction from the closed position is located farther, as viewed from the effort point of the force applied to the actuator 11 at the closed position by the flat plate-like cable 71, than the point of action of the force. In other words, the distance between the effort point and the fulcrum is longer than the distance between the point of action and the fulcrum.

Therefore, the force applied to the point of action is directed obliquely downward. In other words, this force acts in the direction so as to press the actuator 11 in the insertion direction. Hence, even if the force applied to the effort point due to pulling and bending the flat plate-like cable 71 is large, the actuator 11 will not be removed from the housing 31, ensuring connection of the flat plate-like cable 71.

The actuator 11 is provided with the pressing portion 14 which presses the flat plate-like cable 71 against the contacting portions 43*a* of the first terminals 41 and the contacting portions 53*a* of the second terminal 51, when the actuator 11 is at the closed position, and this pressing portion 14 works as the effort point. Further, each of the second terminals 51 is provided with the tip portion 54*a* of the second arm portion 54 extending towards the cable insertion end of the housing 31. The actuator 11 is provided with the third side surface 15*d* which contacts the surface of the housing 31, the surface facing the cable insertion end, when the actuator 11 is at the closed position, and the second terminal accommodating recesses 16 which are open in the third side surface 15*d* and accommodate the tip portions 54*a*. The opening end 16*a* of each of the second terminal accommodating recesses 16 on the side of the flat plate-like cable 71 works as the point of action. Furthermore, the housing 31 is provided with the supporting surfaces 37, the actuator 11 is provided with the rolling surfaces 18 which roll on the supporting surfaces 37, and each of the rolling surfaces 18 includes a planar surface portion 18*a* which contacts the supporting surface 37 when the actuator 11 is at the closed position, and the attitude holding contact limit point 18*c* which is located on the flat plate-like cable 71 side of the planar surface portion 18*a*, and the attitude holding contact limit point 18*c* works as the foregoing fulcrum.

Therefore, it becomes possible to ensure that the actuator 11 is not detached from the housing 31 when the attitude of the actuator 11 is changed further than the closed position, thus obtaining the connector 10 which has high operability, easy structure, and high cable holding capability, and unwanted disengagement due to handling of the flat plate-like cable 71 can be prevented.

Moreover, the rolling surface 18 includes the curved surface portion 18*b* which is connected to the attitude holding contact limit point 18*c* on the side of the flat plate-like cable 71, the curved surface portion 18*b* contacts each of the supporting surfaces 37 when the attitude of the actuator 11 is changed from the opened position to the closed position and is spaced apart from the supporting surfaces 37 when the actuator 11 is at the closed position. In this case, by increasing the length of the curved surface portion 18*b*, the attitude holding contact limit point 18*c* can be shifted in a direction away from the flat plate-like cable 71.

Next, the second embodiment of the present invention is described. Note that, for the elements having the same constructions as those in the first embodiment, the same numerals are used to omit the descriptions thereof. Also, the description of the same operations and effects as those in the first embodiment are also omitted.

FIG. 8 is a cross-sectional view of a side wall of an actuator according to the second embodiment of the present invention, and FIG. 9 is a cross-sectional view of a side wall of a modification of the actuator of the second embodiment of the present invention.

In this embodiment, as shown in FIG. 8, the rolling surface 18 of the side wall 17 includes a stepped planar surface portion 18*d* located between the planar surface portion 18*a* and the curved surface portion 18*b* and recessed from the planar surface portion 18*a*. A step 18*e* which is a border between the planar surface portion 18*a* and the stepped planar surface portion 18*d* becomes the attitude holding contact point and works as the fulcrum of the rotation motion of the actuator 11 when a force is applied to the actuator 11 due to pulling and bending the flat plate-like cable 71. The length of the planar surface portion 18*a* is reduced, and the length of the stepped planar surface portion 18*d* is increased, so the attitude holding contact limit point is shifted in the direction away from the flat plate-like cable 71 (to the left in FIG. 8). Therefore, the distance between a point where the flat plate-like cable 71 contacts the pressing portion 14 and the attitude holding contact limit point is longer than the distance between a point where the opening end 16*a* contacts the tip portion 54*a* and the attitude holding contact limit point.

Accordingly, like the first embodiment described earlier, the fulcrum of the rotation motion of the actuator 11 is located farther, as viewed from the effort point, than the point of action, and therefore, even if a force is applied to the actuator 11 due to handling of the flat plate-like cable 71 connected to the connector 10, the actuator 11 will not rotate, and thus the flat plate-like cable 71 is not detached from the connector 10.

Note that, in the example shown in FIG. 8, since there is the step 18*e* which creates a border between the planar surface portion 18*a* and the stepped planar surface portion 18*d*, when an operator changes the attitude of the actuator 11 from the opened position to the closed position by operating with his/her finger or the like, the step 18*e* of the actuator 11 is run upon. Therefore, when the step 18*e* is run upon, the operator may take a feeling of click as the sign that the actuator 11 is at the closed position and stop operating the actuator 11. Therefore, an operator needs to be careful.

FIG. 9 shows a modification of the example shown in FIG. 8. In the example in FIG. 9, the supporting surface 37 includes a main supporting surface portion 37*a* which supports the rolling surface 18, and a stepped supporting surface portion 37*b* recessed from the main supporting surface portion 37*a*. A point on a planar surface portion 18*a* that meets a step 37*c*, a border between the main supporting surface portion 37*a* and the stepped supporting surface portion 37*b*, is a attitude holding contact limit point. This point on the planar surface portion 18*a* works as a fulcrum of a rotation motion of an actuator 11 when a force is applied by handling of a flat plate-like cable 71. Note that, in the example shown in FIG. 9, the planar surface portion 18*a* is long, and a curved surface portion 18*b* is short.

By reducing the length of the main supporting surface portion 37*a* and increasing the length of the stepped supporting surface portion 37*b*, the attitude holding contact limit point is shifted in the direction away from the flat plate-like cable 71 (to the left in FIG. 9). Therefore, the distance between a point where the flat plate-like cable 71 contacts the pressing portion 14 and the attitude holding contact limit point is longer than the distance between a point where the opening end 16*a* contacts the tip portion 54*a* and the attitude holding contact limit point.

Similarly to the first embodiment, since the fulcrum of the rotation motion of the actuator 11 is located farther, as viewed from the effort point, than the point of action, even if a force is applied to the actuator 11 by handling of the flat plate-like cable 71 connected to the connector 10, the actuator 11 will not rotate, and the flat plate-like cable 71 is not detached from the connector 10.

Note that, in the example shown in FIG. 9, since there is the step 37*c* which creates a border between the main supporting surface portion 37*a* and the stepped supporting surface portion 37*b*, when an operator changes the attitude of the actuator 11 from the opened position to the closed position by operating with his/her finger or the like, the actuator 11 runs upon the step 37*c*. Therefore, when the actuator 11 runs upon the step 37*c*, the operator may take a feeling of click as a sign that the actuator 11 is at the closed position, and stop operating the actuator 11. Therefore, an operator needs to be careful.

The present invention is not limited to the above-described embodiments, and may be changed in various ways based on the gist of the present invention, and these changes are not eliminated from the scope of the present invention.

What is claimed is:

1. A cable connector comprising:

a housing, the housing including an insertion recess for receiving an end of a flat cable;

a plurality of terminals , each terminal being disposed in the housing for connecting to conductive leads of the flat cable;

an actuator , the actuator being attached to the housing so that the attitude of the actuator can be changed between a first position, at which the flat cable can be inserted into the opening, and a second position, at which the actuator presses the conductive leads of the inserted fiat cable into contact with the terminals;

wherein:

the actuator is attached to the housing at a cable insertion end side thereof and brought to the second position when the attitude of the actuator is changed in an insertion direction of the flat plate-like cable; and a fulcrum of the attitude-changing movement of the actuator in the insertion direction further from the second position is located farther, as viewed from an effort point of a force applied by the flat cable to the actuator at the second position, than a point of action of the force.

2. The cable connector according to claim 1, wherein a distance between the effort point and the fulcrum is longer than a distance between the point of action and the fulcrum.

3. The cable connector according to claim 1, wherein the housing has a supporting surface.

4. The cable connector according to claim 1, wherein the housing has a supporting surface.

5. The cable connector according to claim 1, wherein the actuator includes a pressing portion which presses the flat cable against contact portions of the terminals when the actuator is at the second position.

6. The cable connector according to claim 1, wherein the terminals include supporting arm portions extending towards the cable insertion end of the housing.

7. The cable connector according to claim 3, wherein the actuator has a rolling surface for rolling on the supporting surface.

8. The cable connector according to claim 7, wherein the rolling surface includes an attitude holding contact portion, for making contact with the supporting surface when the actuator is at the second position, and an attitude holding contact limit point located at the end of the attitude holding contact portion on the side of the flat cable, for holding contact limit point functioning as the fulcrum.

9. The cable connector according to claim 4, wherein the actuator has a rolling surface for rolling on the supporting surface.

10. The cable connector according to claim 9, wherein the supporting surface includes a main supporting surface portion, which contacts the rolling surface when the actuator is at the second position, a stepped supporting surface portion, which contacts the rolling surface while the attitude of the actuator is changed from the first position to the second position and is spaced apart from the rolling surface when the actuator is at the second position, and a step at a border between the main supporting surface portion and the stepped supporting surface portion, the step functioning as the fulcrum.

11. The cable connector according to claim 5, wherein the pressing portion functions as the effort point.

12. The cable connector according to claim 6, wherein the actuator has a side surface, which contacts a surface of the housing facing the cable insertion end thereof at the second position, and terminal accommodating recesses, which are open in the side surface and accommodate the supporting arm portions.

13. The cable connector according to claim 12, wherein an opening end of the terminal accommodating recess on the side of the flat cable functions as the point of action.

14. The cable connector according to claim 8, wherein the rolling surface includes a curved surface portion connected to the attitude holding contact limit point on the side of the flat plate-like cable.

15. The cable connector according to claim 8, wherein the rolling surface includes a stepped planar surface portion connected to the attitude holding contact limit point on the side of the flat cable.

16. The cable connector according to claim 14, wherein the curved surface portion contacts the supporting surface while the attitude of the actuator is changed from the first position to the second position, and is spaced apart from the supporting surface when the actuator is at the second position.

17. The cable connector according to claim 15, wherein the stepped planar surface portion contacts the supporting surface while the attitude of the actuator is changed from the first position to the second position, and is spaced apart from the supporting surface when the actuator is at the second position.

18. The cable connector according to claim 17, wherein the attitude holding contact limit point is a step.

19. A cable connector comprising:

a housing, the housing including an insertion recess which receives a flat cable is inserted end;

a plurality of terminals each terminal being loaded in the housing for connecting to conductive leads of the flat cable;

an actuator , the actuator being mounted on the housing so that the attitude of the actuator can be changed between a first position, at which the flat cable can be inserted, and a second position, at which the actuator causes the flat cable leads and the terminals to connect to each other;

wherein:

the housing has a support surface;

the terminals supporting arm portions extend towards the cable insertion end of the housing;

the actuator includes a pressing portion which presses the flat cable against the terminal contact portions when the actuator is at the second position, a rolling surface for rolling on the support surface, a side surface which contacts a surface of the housing facing the cable insertion end thereof when the actuator is at the second position, and terminal accommodating recesses which are open in the side surface and accommodate the terminal supporting arm portions;

the rolling surface includes an attitude holding contact portion which contacts the support surface when the actuator is at the second position, and an attitude holding contact limit point located on a side of the flat cable of the attitude holding contact portion; and the attitude holding contact limit point is located farther, as viewed from the pressing portion, than an opening end of the terminal accommodating recess on the side of the flat cable when the actuator is at the second position.

20. A cable connector comprising:

a housing, the housing including an insertion recess into which a flat plate-like cable is inserted;

terminals loaded in the housing and electrically connected to conductive wires of the flat plate-like cable; and an actuator attached to the housing so that the attitude of the actuator can be changed between a first position, at which the flat plate-like cable can be inserted, and a second position, at which the actuator causes the conductive wires of the inserted flat plate-like cable and the terminals to be electrically connected to each other;

wherein:

the housing has a supporting surface;

the terminals include supporting arm portions extending towards the cable insertion end of the housing;

the actuator includes a pressing portion which presses the flat plate-like cable against contact portions of the terminals when the actuator is at the second position, a rolling surface for rolling on the supporting surface, a side surface which contacts a surface of the housing facing the cable insertion end thereof when the actuator is at the second position, and terminal accommodating recesses which are open in the side surface and accommodate the supporting arm portions;

the supporting surface includes a main supporting surface portion which contacts the rolling surface when the actuator is at the second position, a stepped supporting surface portion which contacts the rolling surface while the attitude of the actuator is changed from the first position to the second position and is spaced apart from the rolling surface when the actuator is at the second position, and a step at a border between the main support surface portion and the stepped supporting surface portion; and the step is located farther, as viewed from the pressing portion, than an opening end of the terminal accommodating portion on the side of the flat plate-like cable when the actuator is at the second position.

* * * * *